US009661430B2

(12) United States Patent
Risbo et al.

(10) Patent No.: US 9,661,430 B2
(45) Date of Patent: May 23, 2017

(54) METHOD OF IDENTIFYING PASSIVE RADIATOR PARAMETERS

(71) Applicant: Texas Instruments Incorporated, Dallas, TX (US)

(72) Inventors: Lars Risbo, Hvalsoe (DK); Theis Harboe Christiansen, Solrod (DK)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 14/810,199

(22) Filed: Jul. 27, 2015

(65) Prior Publication Data

US 2016/0037276 A1 Feb. 4, 2016

Related U.S. Application Data

(60) Provisional application No. 62/030,865, filed on Jul. 30, 2014.

(51) Int. Cl.
*H04R 29/00* (2006.01)
*H04R 1/28* (2006.01)

(52) U.S. Cl.
CPC ..... *H04R 29/001* (2013.01); *H04R 1/2834* (2013.01)

(58) Field of Classification Search
CPC ..... H04R 1/2834; H04R 29/001
See application file for complete search history.

(56) References Cited

U.S. PATENT DOCUMENTS 7,184,556 B1 * 2/2007 Johnson ..... H03G 5/005 381/59

OTHER PUBLICATIONS

Hurlburt, Douglas H.: "Complete Response Function and System Parameters for a Loudspeaker with Passive Radiator", Journal of AES, vol. 48, No. 3, Mar. 1, 2000 (Mar. 1, 2000), pp. 147-163.*
"Parameter Measurement of Passive Radiators AN57", Application Note to the Klippel R&D System v. (Aug. 6, 2013). Retrieved Sep. 16, 2016, from https://www.klippel.de/fileadmin/klippel/Files/Know_How/Application_Notes/AN_57_Passive_Radiator.pdf.*

* cited by examiner

*Primary Examiner* — Brenda Bernardi
(74) *Attorney, Agent, or Firm* — Goutham Kondapalli; Charles A. Brill; Frank D. Cimino

(57) ABSTRACT

Methods for modeling a loudspeaker having a passive radiator include applying a stimulus signal to a speaker within the cabinet, wherein the stimulus is applied over a frequency range. The sound pressure level (SPL) in the cabinet is measured as a function of frequency during application of the stimulus signal. At least one coefficient based on the measured SPL is derived, wherein at least one passive radiator parameter is a function of the at least one coefficient.

20 Claims, 4 Drawing Sheets

METHOD OF IDENTIFYING PASSIVE RADIATOR PARAMETERS

This application claims priority to U.S. provisional patent application 62/030,865 of Lars Risbo for LOW-COST IDENTIFICATION OF PASSIVE RADIATOR PARAMETERS filed on Jul. 30, 2014, which is incorporated herein for all that is disclosed.

BACKGROUND

Some ultra compact loudspeakers often include a passive radiator to extend the bass reproduction emitted from the loudspeakers. A passive radiator functions as a speaker without a motor (voice coil and magnet). A passive radiator generates an extra resonance and adds a complex pole pair to the transfer function of the loudspeaker, which results in a complex fifth order electromechanical model for the loudspeaker.

Identification of passive radiator parameters is essential for correct tuning and sound compensation of the loudspeaker. Such identification has previously been very complicated due to the complex pole pair resulting from the passive radiator. In some applications identification is performed using a special separate test box that requires a laser to measure the movement of the passive radiator in response to stimulus signals generated by an active sound source, such as an active speaker. These identification techniques and test boxes are very costly and time consuming to operate.

SUMMARY

Methods for modeling a loudspeaker having a passive radiator include applying a stimulus signal to a speaker within the cabinet, wherein the stimulus is applied over a frequency range. The sound pressure level (SPL) in the cabinet is measured as a function of frequency during application of the stimulus signal. At least one coefficient based on the measured SPL is derived, wherein at least one passive radiator parameter is a function of the at least one coefficient.

In some examples, measuring the SPL includes measuring the impedance into a microphone located within the cabinet, measuring the voltage on a microphone located within the cabinet, or measuring the current through a microphone located in the cabinet.

In some examples, application of a stimulus signal includes applying a signal that changes frequency over time, applying a signal that includes a plurality of frequencies, applying a swept sine wave, or applying a chirp signal.

The methods may further include measuring the impedance of the speaker during application of the stimulus signal and fitting a curve to the SPL of the microphone and the impedance of the speaker. Deriving at least one coefficient includes deriving at least one coefficient of the curve, wherein at least one passive radiator parameter is a function of the at least one coefficient.

Examples of loudspeakers include a sealed cabinet having an interior; a speaker mounted within a hole in the cabinet so as to radiate sound external to the cabinet; a passive radiator having a cone wherein the cone moves in response to changes in the SPL in the interior of the cabinet; and a measuring device for measuring the SPL within the interior of the cabinet in response to activation of the speaker. In some examples, the measuring device is a microphone.

In some examples, the loudspeaker has a voltage detector coupled to the microphone, wherein the SPL is a function of voltage across the microphone. In other examples, the loudspeaker has an impedance detector coupled to the microphone, wherein the SPL is a function of the impedance of the microphone. In yet other examples, the loudspeaker has a current detector coupled to the microphone, wherein the SPL is a function of the current flow through the microphone. The loudspeaker may also have an impedance detector coupled to the speaker.

Some examples of the loudspeaker include a signal generator coupled to the speaker for activating the speaker. The activation may be with at least one predetermined frequency.

Other methods for operating a loudspeaker having a passive radiator include: applying a stimulus signal to a speaker within the cabinet, the stimulus being applied over a frequency range; measuring the SPL in the cabinet as a function of frequency during application of the stimulus signal; measuring the impedance of the speaker during application of the stimulus signal; fitting a curve to the SPL of the microphone and the impedance of the speaker; deriving at least one coefficient based on the measured SPL, wherein at least one passive radiator parameter is a function of the at least one coefficient; and generating a signal to operate the speaker based on the at least one passive radiator parameter.

In some examples, measuring the SPL in the cabinet comprises measuring the sound pressure level of a microphone located in the cabinet as a function of frequency during application of the stimulus signal. In other examples, measuring the SPL in the cabinet comprises measuring the voltage across a microphone located in the cabinet as a function of frequency during application of the stimulus signal.

DETAILED DESCRIPTION

Figure 1:
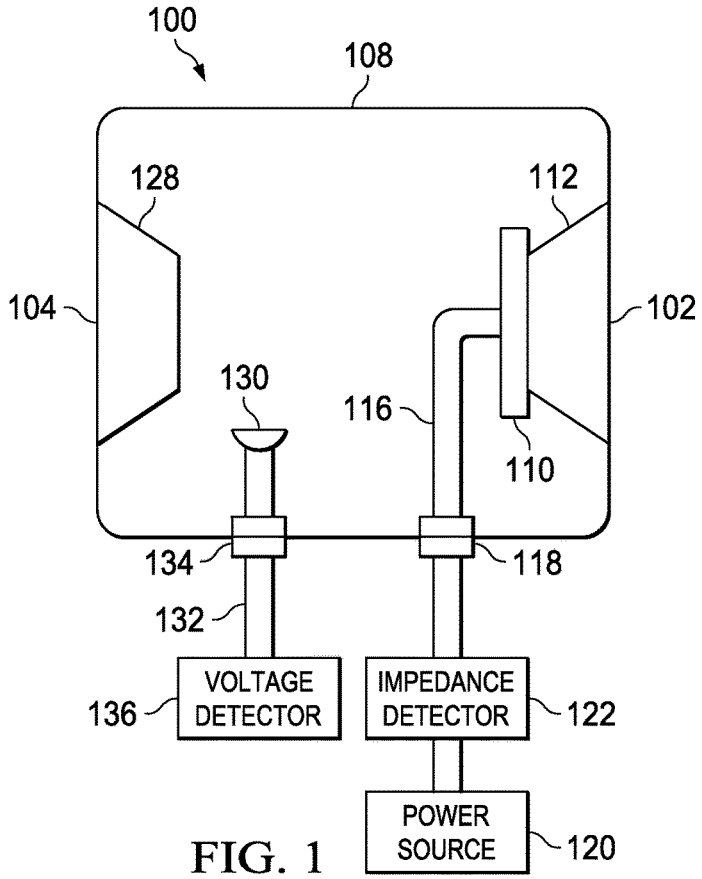
FIG. 1 is a block diagram of an example loudspeaker that includes an active speaker, a passive radiator, and a microphone.

FIG. 1 is a block diagram of a loudspeaker 100 with a speaker 102 and a passive radiator 104 located therein. Both the speaker 102 and the passive radiator 104 are located within a sealed cabinet 108 wherein the sound pressure level (SPL) of the interior of the cabinet 108 changes when the speaker 102 operates. Both the speaker 102 and the passive radiator 104 have at least one component that is located in and/or extends through an opening in the cabinet 108. The SPL within the cabinet 108 generated by the speaker 102 causes the passive radiator 104 to radiate and generate additional sound from the loudspeaker 100. The passive radiator 104 typically enhances the low frequency performance of the loudspeaker 100. The operation of the passive radiator 104 is dependent on the SPL, which is dependent on many factors, such as the volume of the cabinet 108, and the operation of the speaker 102, and the characteristics of the passive radiator 104. For example, stiff suspension material in the passive radiator 104 will not move as freely as loose material, which may result in different SPL characteristics of the loudspeaker 100.

The speaker 102 includes a motor 110 and a cone 112, wherein the cone 112 is exposed to the exterior of the cabinet 108 to emit sound from the cabinet 108. The motor 110 is coupled to wires 116 that couple the speaker 102 to a connector 118 in the cabinet 108. The connector 118 is coupled to a power source 120 that provides power to the motor 110. In use, the motor 110 moves the cone 112 to produce sound waves in response to signals provided by the power source 120. The movement of the cone 112 changes the SPL in the cabinet 108, which causes the passive radiator 104 to move and generate sound.

The power source 120 generates predetermined signals for identifying at least one parameter of the passive radiator 104 as described below. An impedance detector 122 is coupled between the power source 120 and the connector 118 to measure the impedance of the motor 110 during the identification of the passive radiator parameters. During normal operation of the loudspeaker 100 the impedance detector 122 and/or the power source 120 may be removed and replaced with a device that provides conventional signals to the loudspeaker 100. In some examples, the impedance detector 122 measures the voltage on the speaker 102 and the current flow through the speaker 102 and calculates the impedance based on these measurements.

The passive radiator 104 of FIG. 1 is a cone 128 without a motor. The cone 128 is located within an opening in the cabinet 108, however, the cabinet 108 remains sealed. The SPL in the cabinet 108 vibrates the cone 128 in response to the movement of the cone 112 in the speaker 102. Accordingly, there is a transfer function between the power applied to the speaker 102 and the movement of the cone 128 wherein the transfer function is a function of the SPL. In loudspeakers that include passive radiators, the transfer function is a complex fifth order function.

Figure 2:
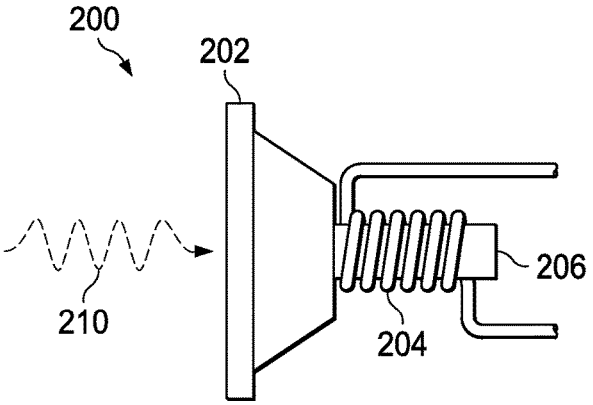
FIG. 2 is a schematic diagram of an example of the microphone of FIG. 1.

A microphone 130 is located in the cabinet 108 so as to measure the SPL generated by the speaker 102. A microphone is an example of a device for measuring the SPL in the cabinet 108. In other examples, other sound pressure measuring devices may be used to measure the SPL. In some examples the microphone 130 is a simple off-the-shelf microphone, such as a condenser microphone. FIG. 2 is a schematic diagram of an example microphone 200, such as the microphone 130 of FIG. 1. The microphone 200 includes a diaphragm 202, a coil 204, and a permanent magnet 206. The coil 204 is affixed to the diaphragm 202 and moves as the diaphragm 202 moves. The magnet 206 is a permanent magnet that is held in a fixed location so that the coil 204 moves relative to the magnet 206. Sound waves 210, which are proportional to the SPL in the cabinet 108, vibrate the diaphragm 202, which moves the coil 204 relative to the magnet 206. This movement in the field of the magnet 206 generates current in the coil 204 that is the output of the microphone 200. The greater the SPL, the greater the magnet 206 moves relative to the coil 204.

Other types of microphones may be used in place of the microphone 200 described in FIG. 2. For example, condenser microphones and electret condenser microphones may be used as the microphone 130. A condenser microphone is based on a capacitor wherein a first plate of the capacitor is the diaphragm and moves relative to the second plate in response to and proportional to changes in the SPL. The change in capacitance generates signals that are a function of the movement of the first plate relative to the second plate and are a function of the SPL.

Referring again to FIG. 1, the microphone 130 is sealed within the cabinet 108 to prevent air from leaking around the microphone 130. At least the diaphragm of the microphone 130 is located within the cabinet 108 or is accessible to the interior of the cabinet 108 so that it may move or vibrate with changes in the SPL within the cabinet 108 resulting from movement of the cone 112. In the example of FIG. 1, the whole microphone 130 is located within the cabinet 108 and wires 132 coupled to the microphone 130 pass through a sealed connector 134 in the cabinet 108. In other examples, a hole is located in the cabinet 108 and the microphone 130 is located in the hole so that the diaphragm 202 has access to the interior of the cabinet 108.

Figure 3:
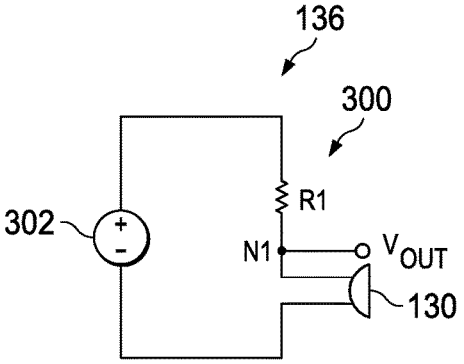
FIG. 3 is a simplified circuit of an example of the voltage detector of FIG. 1.

The microphone 130 is coupled to an SPL measuring device, which in the examples described in FIG. 1 is a voltage detector 136. Other devices that measure the movement of the diaphragm of the microphone 200 may be substituted for the voltage detector 136. For example, an impedance detector or a current detector may be substituted for the voltage detector. FIG. 3 is a simplified circuit 300 of an example of the voltage detector 136. The circuit 300 includes a voltage source 302 coupled in series with an impedance R1 and the microphone 130. An output node N1 is coupled between the impedance R1 and the microphone 130 wherein an output voltage $V_{OUT}$ is present at the node N1. Accordingly, the voltage $V_{OUT}$ is proportional to the movement of the diaphragm 202, FIG. 2, which is proportional to the SPL in the cabinet 108, FIG. 1. In some examples, the movement of the coil 204 relative to the magnet 206 generates a voltage across the microphone 130, so the voltage source 302 is not necessary.

Referring again to FIG. 2, as the diaphragm 202 moves the coil 204 relative to the magnet 206, the impedance seen looking into the coil 204 changes as a function of the movement. Accordingly, the impedance looking into the coil 204 is a function of the SPL. This impedance may be measured by the voltage detector 136 as described above. A similar process occurs with a condenser microphone wherein the distance between the capacitive plates changes with changes in the SPL, which cause the impedance between the capacitive plates to change. This capacitive impedance may also be measured by the voltage detector 136.

The process of identifying the parameters or modeling the passive radiator 104 commences with generating a stimulus signal with the speaker 102. The power source 120 generates the stimulus signal, which may be a swept sine wave, chirps, or other signals that may include a frequency spectrum. The motor 110 receives the signals generated by the power source 120 and moves the cone 112 as a function of the signals. The impedance of the motor 110 changes as a function of the frequency of the signals generated by the power source 120 and this impedance is measured by the impedance detector 122.

When the cone 112 vibrates or otherwise moves, the movement changes the SPL within the cabinet 108. If the cabinet 108 did not include the passive radiator 104, the change in SPL would somewhat directly correspond with the movement of the cone 112. However, the SPL within the cabinet 108, in response to the movement of the cone 112, moves the cone 128 of the passive radiator 104. Accordingly, the parameters of the passive radiator 104, along with other characteristics of the loudspeaker 100, affect the SPL within the cabinet 108. For example, if the cone 128 of the passive radiator is more responsive or moves more in response to lower frequencies than high frequencies, the SPL will be lower at lower frequencies than at higher frequencies. The transfer function between the stimulus applied to the speaker 102 and the SPL is a fifth order function dependent on the parameters of the passive radiator 104.

During application of the stimulus signal to the speaker 102, the voltage of the microphone 130 is measured by the voltage detector 136. As described above, the diaphragm 202 in the microphone 130 moves the coil 204 in response to sound waves 210 within the cabinet 108. The movement of the coil 204 in the magnetic field of the magnet 206 changes the impedance into the coil 204, which is measured by the voltage detector 136 as described above. Current detectors and impedance detectors can also measure the movement of the diaphragm.

Figure 4:
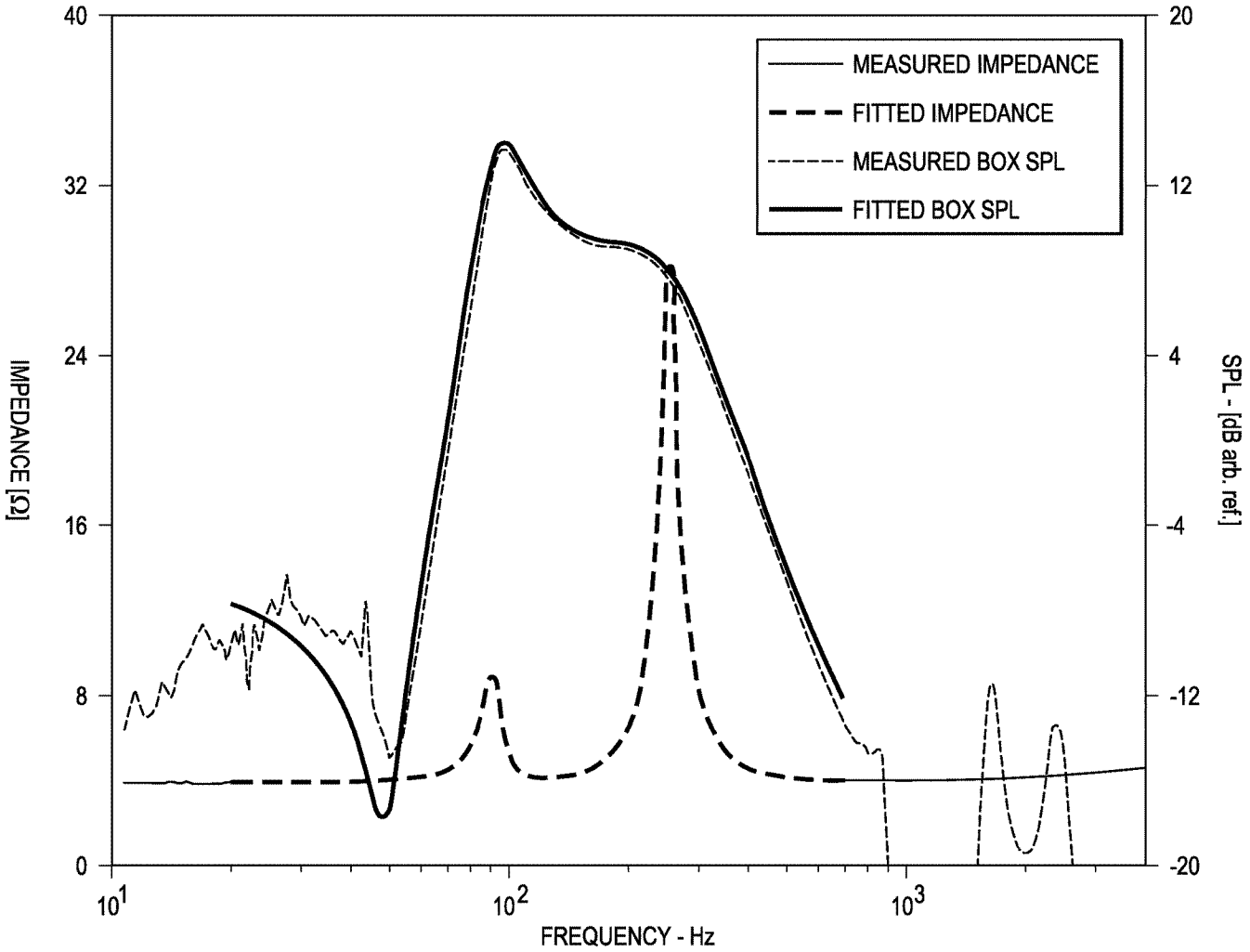
FIG. 4 is a graph showing examples of the sound pressure level (SPL) within the loudspeaker of FIG. 1 and the impedance of the active speaker in response to a stimulus signal output to the active speaker.

FIG. 4 is a graph showing the measured impedances of the speaker 102 (thin, solid line) and the SPL measured by the microphone 130 (thin, dashed line). The voltage on the microphone is proportional to the SPL. A thick dashed line is the fitted impedance of the speaker 102. The SPL signal is normalized, so the shapes and not the amplitudes of the impedance and SPL are processed. Based on the impedance and SPL measurement, a 5th-order state space filter of the loudspeaker 100 is derived as shown by the thick solid line. The thick solid line is the fit of the SPL measured by the microphone 130. For example, a constrained multi-dimensional optimization routine, such as MATLAB, is used to minimize a function by finding the optimal coefficients for a curve that fits the impedance and SPL as a function of frequency. In some embodiments, a cost function is performed that measures the deviation between the measured impedance and SPL to derive a state-space model of the loudspeaker 100. The coefficients of the curves and/or model represent the characteristics of loudspeaker 100.

As described above, the SPL measurement is normalized. Therefore, no sensitivity calibration of the microphone 130 is required. Nor is calibration of the speaker 102 required. Accordingly, the processing of the data from the SPL detector is only sensitive to the shape of the SPL curves as a function of frequency and not the absolute level or amplitude of the impedance as a function of frequency. Accordingly, most simple microphones are suited to perform the functions of the microphone 130 described herein.

When the parameters of the loudspeaker 100 are known, a processor or the like (not shown) may adjust the frequency characteristics of signals to the speaker 102 to optimize the speaker 102 and the passive radiator 104. For example, when the speaker parameters are known, the SPL resulting from the speaker 102 at low frequencies can be derived. A compensation filter is calculated based on the SPL to coincide with a user-defined target output signal.

Figure 5:
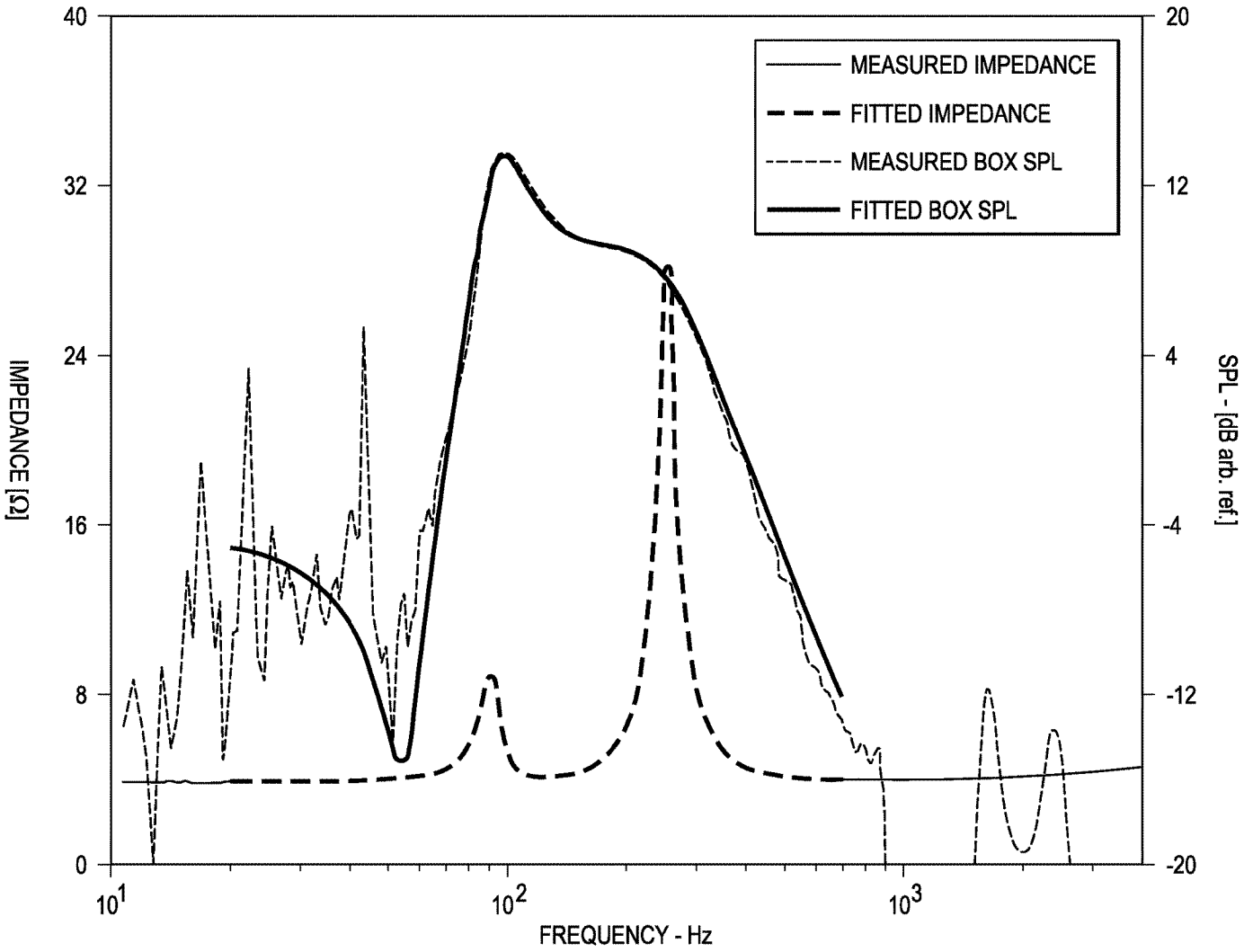
FIG. 5 is a graph showing examples of the SPL within the loudspeaker of FIG. 1 and the impedance of the active speaker in response to a stimulus signal output to the active speaker wherein the processing is erroneous.

Some microphones may not be able to record the SPL at low frequencies or large SPLs. For example, some microphones may clip the output voltage $V_{OUT}$, FIG. 3. FIG. 5 is a graph showing the impedances of the speaker 102 and SPL wherein the microphone 130 does not have the range to measure the SPL in the cabinet 108. The measured SPL has a plurality of peaks as a function of frequency, which is indicative of distortion caused by a higher SPL than can be measured by the microphone 130. This problem may be resolved by lowering the amplitude of the stimulus signal output to the speaker 102 or replacing the microphone 130 with a microphone having a greater range.

Figure 6:
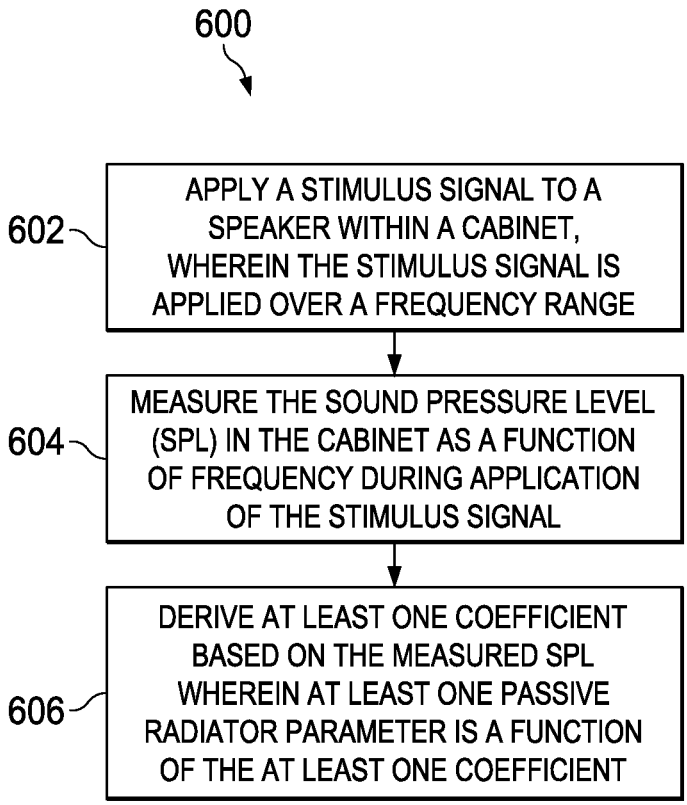
FIG. 6 is a flowchart describing a method of identifying at least one passive radiator parameter.

FIG. 6 is an example flowchart 600 describing an example of identifying at least one parameter of a passive radiator. In step 602 a stimulus signal is applied to a speaker within a cabinet, wherein the stimulus signal is applied over a frequency range. In step 604, the sound pressure level (SPL) in the cabinet is measured as a function of frequency during application of the stimulus signal. In step 606 at least one coefficient based on the measured SPL is derived, wherein at least one passive radiator parameter is a function of the at least one coefficient.

While some examples of passive radiator parameter identification devices and methods have been described in detail herein, it is to be understood that the inventive concepts may be otherwise variously embodied and employed and that the appended claims are intended to be construed to include such variations except insofar as limited by the prior art.

What is claimed is:

1. A method for modeling a loudspeaker having a passive radiator, the method comprising:

applying a stimulus signal to a speaker within a cabinet, the stimulus being applied over a frequency range;

measuring a sound pressure level (SPL) in the cabinet as a function of frequency during application of the stimulus signal; and deriving at least one coefficient based on the measured SPL, wherein at least one parameter of the passive radiator is a function of the at least one coefficient.

2. The method of claim 1, wherein measuring the SPL comprises measuring an impedance into a microphone located within the cabinet.

3. The method of claim 1, wherein measuring the SPL comprises measuring a voltage on a microphone located within the cabinet.

4. The method of claim 1, wherein measuring the SPL comprises measuring a current through a microphone located within the cabinet.

5. The method of claim 1, wherein application of the stimulus signal comprises applying a signal that changes frequency over time.

6. The method of claim 1, wherein application of the stimulus signal comprises applying a signal that includes a plurality of frequency components.

7. The method of claim 1, wherein application of a stimulus signal comprises applying a swept sine wave.

8. The method of claim 1, wherein application of a stimulus signal comprises applying a chirp signal.

9. The method of claim 1 further comprising:

measuring an impedance of the speaker during application of the stimulus signal; and fitting a curve to the SPL of the microphone and the impedance of the speaker;

wherein deriving at least one coefficient comprises deriving at least one coefficient of the curve, wherein at least one passive radiator parameter is a function of the at least one coefficient.

10. A loudspeaker comprising:

a sealed cabinet having an interior;

a speaker mounted within a hole in the cabinet so as to radiate sound external to the cabinet;

a passive radiator having a cone wherein the cone moves in response to changes in the sound pressure level (SPL) in the interior of the cabinet;

a measuring device for measuring the SPL within the interior of the cabinet in response to activation of the speaker.

11. The loudspeaker of claim 10, wherein the measuring device is a microphone.

12. The loudspeaker of claim 11 further comprising:

a voltage detector coupled to the microphone, wherein the SPL is a function of a voltage across the microphone.

13. The loudspeaker of claim 11 further comprising:

an impedance detector coupled to the microphone, wherein the SPL is a function of an impedance of the microphone.

14. The loudspeaker of claim 11 further comprising:

a current detector coupled to the microphone, wherein the SPL is a function of a current flowing through the microphone.

15. The loudspeaker of claim 10 further comprising:

an impedance detector coupled to the speaker.

16. The loudspeaker of claim 10 further comprising:

a signal generator coupled to the speaker, the signal generator being used for activating the speaker.

17. The loudspeaker of claim 16, wherein the signal generator is used for activating the speaker with at least one frequency.

18. A method for operating a loudspeaker having a passive radiator, the method comprising:

applying a stimulus signal to a speaker within a cabinet, the stimulus being applied over a frequency range;

measuring a sound pressure level (SPL) in the cabinet as a function of frequency during application of the stimulus signal;

measuring an impedance of the speaker during application of the stimulus signal;

fitting a curve to the SPL of the microphone and the impedance of the speaker;

deriving at least one coefficient based on the measured SPL, wherein at least one parameter of the passive radiator is a function of the at least one coefficient; and generating a signal to operate the speaker based on the at least one passive radiator parameter.

19. The method of claim 1, wherein measuring the SPL in the cabinet comprises measuring the SPL of a microphone located in the cabinet as a function of frequency during application of the stimulus signal.

20. The method of claim 19, wherein measuring the SPL in the cabinet comprises measuring the voltage across the microphone located in the cabinet as a function of frequency during application of the stimulus signal.

* * * * *